US008230634B1

(12) United States Patent
Davies et al.

(10) Patent No.: US 8,230,634 B1
(45) Date of Patent: Jul. 31, 2012

(54) TWO PIECE UPPER RECEIVER FOR FIREARMS

(76) Inventors: Robert Bruce Davies, Tempe, AZ (US); Robert Lynch Hogan, Glendale, AZ (US)

( * ) Notice: Subject to any disclaimer, the term of this patent is extended or adjusted under 35 U.S.C. 154(b) by 0 days.

(21) Appl. No.: 13/105,893

(22) Filed: May 12, 2011

Related U.S. Application Data

(63) Continuation of application No. 12/497,048, filed on Jul. 2, 2009.

(51) Int. Cl.
*F41A 21/00* (2006.01)
*F41A 21/48* (2006.01)

(52) U.S. Cl. ..... 42/75.02

(58) Field of Classification Search ..... 42/75.01, 42/75.02, 71.01, 85; 89/14.1
See application file for complete search history.

(56) References Cited

U.S. PATENT DOCUMENTS

| | | | | |
|---|---|---|---|---|
| 5,343,650 | A * | 9/1994 | Swan | 42/117 |
| 6,490,822 | B1 * | 12/2002 | Swan | 42/71.01 |
| 7,905,041 | B1 * | 3/2011 | Davies | 42/75.02 |
| 8,091,265 | B1 * | 1/2012 | Teetzel et al. | 42/72 |
| 2006/0010748 | A1 * | 1/2006 | Stoner et al. | 42/71.01 |
| 2007/0169393 | A1 * | 7/2007 | Frost | 42/124 |
| 2011/0000119 | A1 * | 1/2011 | Desomma et al. | 42/75.02 |
| 2011/0016762 | A1 * | 1/2011 | Davies | 42/75.01 |

* cited by examiner

*Primary Examiner* — Bret Hayes

(57) ABSTRACT

A two piece upper receiver for a firearm including a first piece having a front end, a rear end, a top, and a bottom, the first piece constructed to operatively carry a bolt carrier and bolt, and to have a barrel coupled to the front end. The bottom is constructed to have a lower receiver coupled thereto. The first piece includes a backbone extending along the top between the front end and the rear end, the back bone having upwardly directed indexing surfaces. A second piece overlies the backbone and includes mating surfaces engaging the indexing surfaces, aligning the second piece with the first piece. A receiving structure is opposite the mating surfaces for receiving accessory devices mounted thereon. Fasteners fixedly attach the second piece to the first piece to form a complete upper receiver.

10 Claims, 4 Drawing Sheets

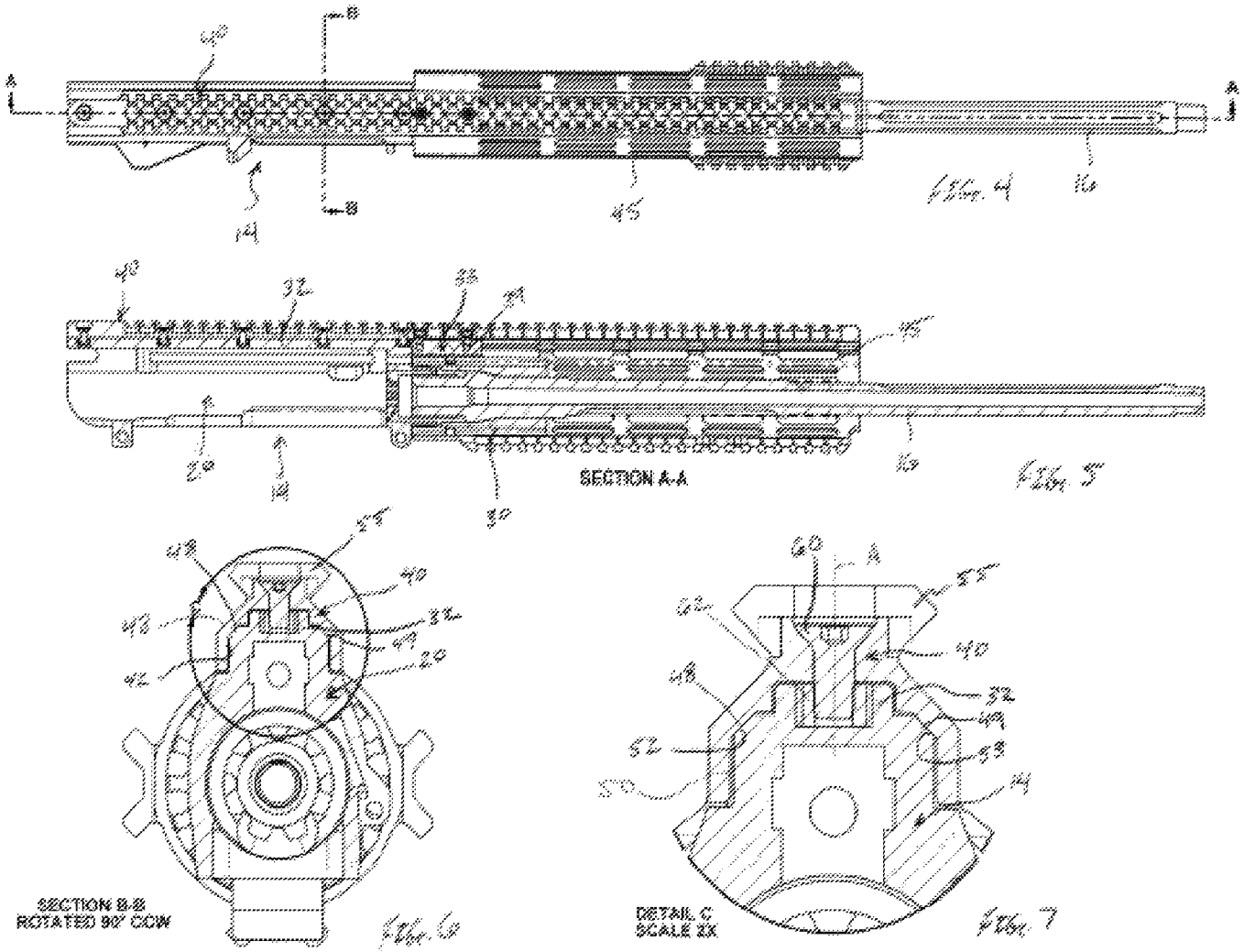
SECTION A-A
DETAIL C
SCALE 2X
SECTION B-B
ROTATED 90° CCW

TWO PIECE UPPER RECEIVER FOR FIREARMS

CROSS-REFERENCE TO RELATED APPLICATIONS

This application is a continuation of U.S. patent application Ser. No. 12/497,048 filed on 2 Jul. 2009. The disclosure of which is incorporated herein by reference in its entirety.

FIELD OF THE INVENTION

This invention relates to firearms. More particularly, the present invention relates to firearms having an upper receiver coupled to a lower receiver.

BACKGROUND OF THE INVENTION

In the field of firearms, and specifically AR10, AR15 or M16 type firearms, various accessories for sighting to improve putting bullet on target, are employed. These sighting devices must be securely, rigidly and accurately attached to a firearm. To this end, firearms include an upper receiver formed of a single piece and having an upper surface designed to receive various sighting devices. The upper surface is formed as a rail for receiving and registering sighting devices. While effective, the typical rail is a Picatinny rail type that includes cross channels used for receiving and registering the sighting devices attached thereto. The formation of cross channels in the upper surface of the upper receiver thins the material of the upper receiver and can adversely affect rigidity. The slight flexibility in the upper receiver will adversely impact accuracy.

It would be highly advantageous, therefore, to remedy the foregoing and other deficiencies inherent in the prior art.

SUMMARY OF THE INVENTION

Briefly, to achieve the desired objects and advantages of the instant invention provided is a two piece upper receiver for a firearm including a barrel. The two piece upper receiver includes a first piece having a front end, a rear end, a top, and a bottom. The first piece is constructed to operatively carry a bolt carrier and bolt, and to have the barrel coupled to the front end. The bottom is constructed to have a lower receiver coupled thereto. The first piece includes a backbone extending along the top between the front end and the rear end and having upwardly directed indexing surfaces. A second piece overlies the backbone of the first piece and includes mating surfaces engaging the indexing surfaces aligning the second piece with the first piece. A receiving structure is opposite the mating surfaces for receiving accessory devices mounted thereon. Fasteners fixedly attach the second piece to the first piece to form a complete upper receiver.

In yet another aspect, the backbone defines the indexing surfaces which are upwardly directed and angularly opposed. Each of the angularly opposed indexing surfaces lies on a separate plane, which planes intersect at a ninety degree angle. Only the mating surfaces of the second piece engage the backbone of the first piece.

In a further aspect, the second piece has an inner surface and an outer surface. The second piece overlies and partially encloses the backbone of the first piece. The inner surface defines the mating surfaces. The mating surfaces are downwardly directed and angularly opposed and the outer surface includes the receiving structure for receiving accessory devices mounted thereon. Only the mating surfaces engage the backbone at the indexing surfaces. Gaps are defined between remaining portions of the inner surface and the backbone.

In yet another aspect of the present invention, a firearm is provided. The firearm includes a barrel, a lower receiver, and a two piece upper receiver. The two piece upper receiver includes a first piece having a front end, a rear end, a top, and a bottom. The first piece carries a bolt carrier and bolt and the barrel is coupled to the front end. The lower receiver is coupled to the bottom of the first piece of the two piece upper receiver. The first piece includes, as an integral part, a backbone extending along the top between the front end and the rear end, the back bone having upwardly directed indexing surfaces, a second piece overlying the backbone of the first piece and including downwardly directed mating surfaces engaging the indexing surfaces. The engaged mating surfaces and indexing surfaces align the second piece with the first piece. A receiving structure is opposite the mating surfaces for receiving accessory devices mounted thereon. Fasteners fixedly attach the second piece to the first piece to form a complete upper receiver.

Also provided is a firearm including a barrel nut having an outer surface. The barrel nut couples the barrel to the front end of the first piece. The second piece extends beyond the front end of the first piece, and a wedge block is provided having a lower surface overlying the barrel nut in an abutting relationship, and an upper surface received adjacent the inner surface of the second piece. A tensioning system is formed between the wedge block and the second piece. The tensioning system forces the wedge block against the barrel nut. In a specific aspect, the tensioning system includes at least one threaded insert received within an aperture extending through the second piece from the outer surface to inner surface, and at least one screw threaded through the threaded insert and engaging the upper surface of the wedge block, forcing the wedge block against the barrel nut.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which:

FIG. 4 is a top view of the two piece upper receiver of FIG. 2;

FIG. 5 is a sectional side view of the two piece upper receiver taken along line 5-5 of FIG. 4;

FIG. 6 is a sectional end view of the two piece upper receiver taken along line 6-6 of FIG. 4; an FIG. 7 is an enlarged portion of FIG. 6 illustrating the indexing of the two piece upper receiver pieces.

DETAILED DESCRIPTION OF THE PREFERRED EMBODIMENT

Figure 1:
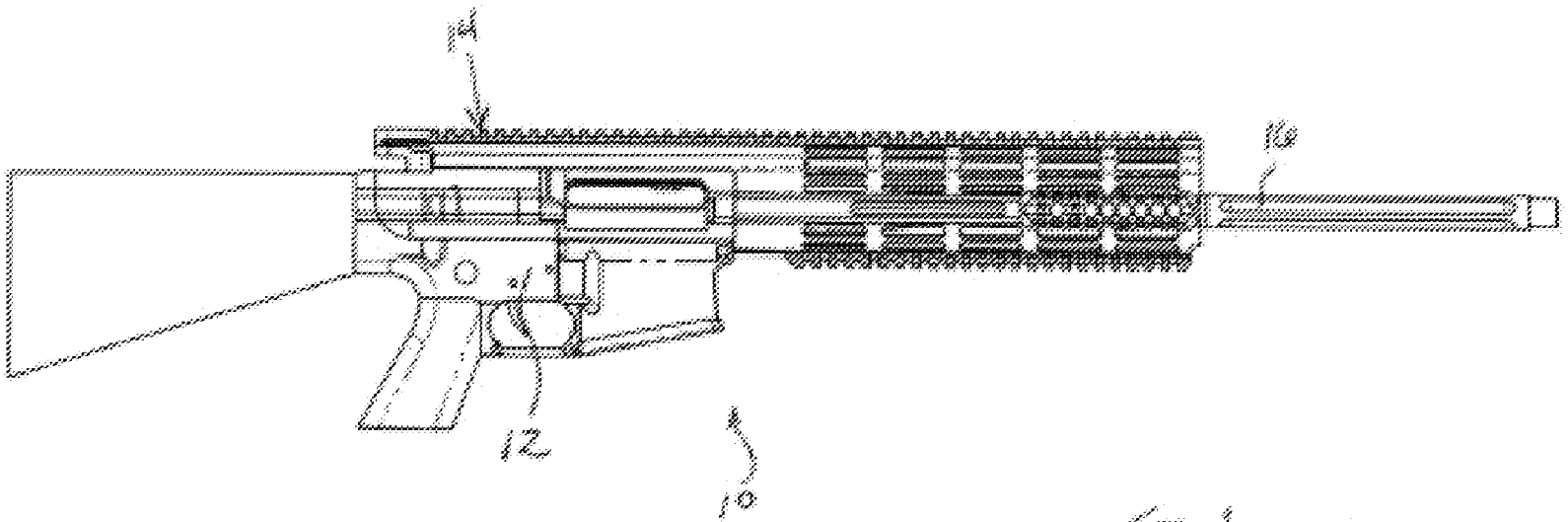
FIG. 1 is a side view of a firearm with a two piece upper receiver according to the present invention.
Figure 2:
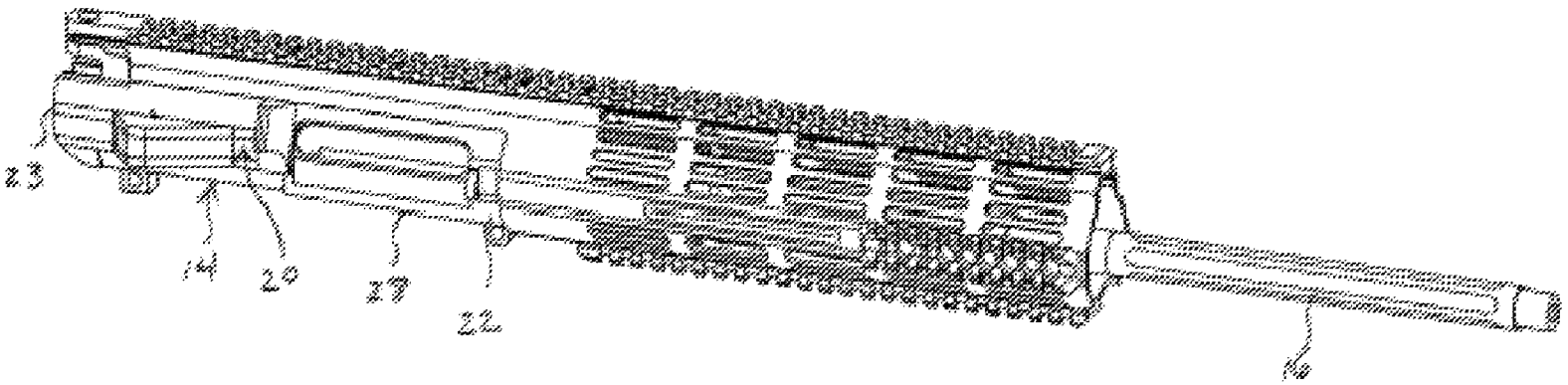
FIG. 2 is a perspective view of a two piece upper receiver according to the present invention.
Figure 3:
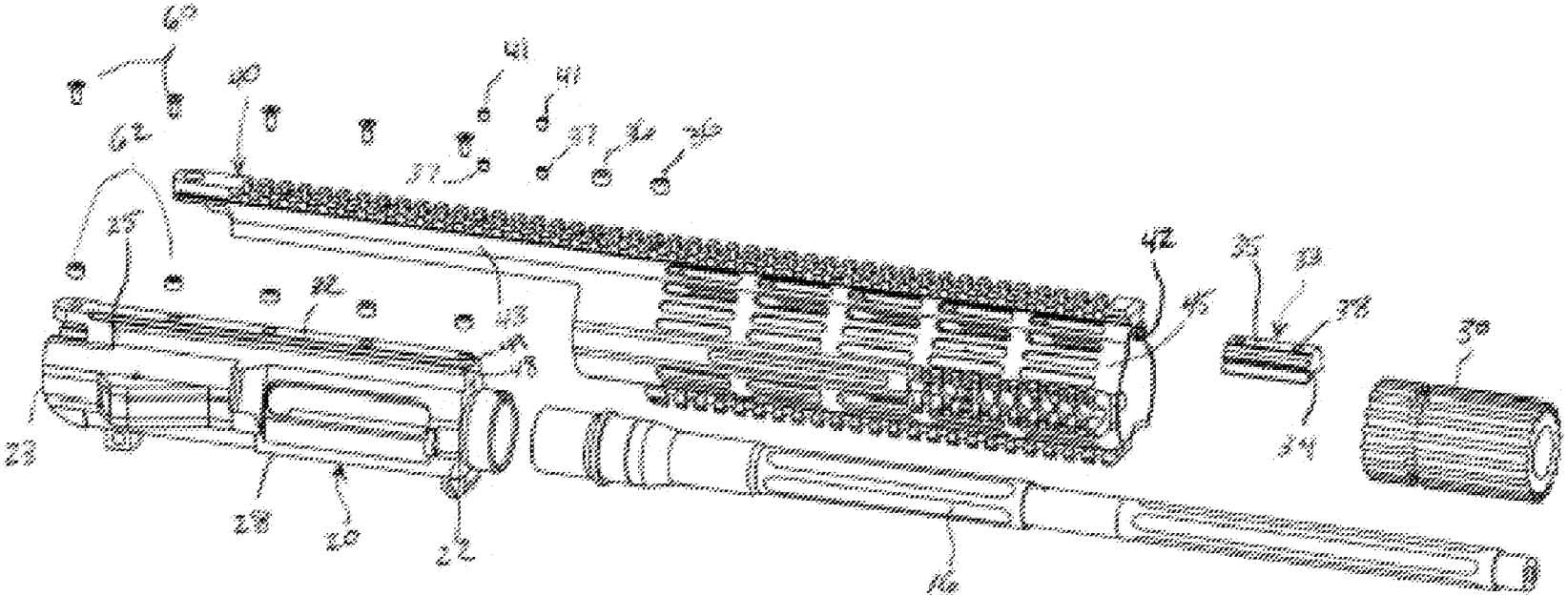
FIG. 3 is an exploded perspective view of the two piece upper receiver of FIG. 2.

Turning now to the drawings in which like reference characters indicate corresponding elements throughout the several views, attention is first directed to FIG. 1 which illustrate a firearm generally designated 10. Firearm 10 includes a lower receiver 12, a two piece upper receiver 14 carried by lower receiver 12, and a barrel 16 coupled to two piece upper receiver 14. In the preferred embodiment, firearm 10 is an auto-loading rifle of the AR10, AR15 or M16 type.

Turning now to FIGS. 2-5, two piece upper receiver 14 for firearm 10 is illustrated. Two piece upper receiver 14 includes a first piece 20 having a front end 22, a rear end 23, a top 25, and a bottom 28. First piece 20 is constructed to operatively carry a bolt carrier and bolt. These elements are not described in detail as they are conventionally known and used in this application. The novelty lies in the unique two piece construction of two piece upper receiver 14. Barrel 16 is coupled to front end 22 with a barrel nut 30. Lower receiver 12 (as can be seen in FIG. 1) is coupled to bottom 28 of first piece 20 of two piece upper receiver 14. First piece 20 includes a backbone 32 extending along top 25 between front end 22 and rear end 23. In this embodiment, backbone 32 is an integral part of first piece 20. The term "integral" as employed herein, refers to a one-piece, common component including the various elements described. For example, first piece 20 can be machined or cast from a single piece of material. Backbone 32 has a length extending substantially from front end 22 to rear end 23, and has a continuous thickness along the length thereof providing rigidity and strength to first piece 20. The continuous thickness of backbone 32 is uncompromised by transversely thinning discontinuities, such as the transverse channels used in conventional rail systems. With the thickness undiminished along the entire length, rigidity is maintained along the entire length, greatly improving both the strength and accuracy of the firearm.

Two piece upper receiver 14 further includes a second piece 40. Second piece 40 includes an inner surface 42 and an outer surface 43, and overlies and partially encloses backbone 32 of first piece 20. In this embodiment, a handguard 45 has been fabricated as an integral part of second piece 40. In this instance, second piece 40 extends forwardly past forward end 22 of first piece 20. It will be understood that handguard 45 can be omitted or other handguard systems can be used with two piece upper receiver 14 of the present invention. When handguard 45 is present as a portion of second piece 40 of upper receiver 14, the entire receiver 14 can be further stabilized with respect to barrel 16 with the use of a wedge block 33. Wedge block 33 includes a lower surface 34 configured to overlie barrel nut 30 in an abutting relationship, and an upper surface 35 configured to be received against inner surface 42 of second piece 40 extending beyond end 33 of first piece 20. A tensioning system is provided for forcing the wedge block against the barrel nut. The tensioning system, in this embodiment, includes threaded inserts 36 and screws 37. Inserts 36 are received within apertures extending entirely through second piece 40, from outer surface 43 to inner surface 42. Screws 37 are threaded through each threaded insert 36, and engage upper surface 35 of wedge block 33. In the preferred embodiment, screws 37 extend into blind apertures 38 formed in upper surface 35 of wedge block 33. As screws 37 are threaded through inserts 36, they force wedge block 33 against barrel nut 30. The tension system formed between barrel nut 30, wedge block 33 and second portion 40 greatly increases the rigidity and thereby increasing accuracy of the firearm. The bottom of apertures 38 can be lined or otherwise protected with a hardened material to prevent damage to the wedge block from screws 37. In the preferred embodiment, wedge block 33 is fabricated from aluminum which is relatively soft and may be damaged by screws 37. Damage to wedge block 33 is prevented by placing small steel balls 39 (FIG. 5) in the bottom of apertures 38. The rounded surface of steel balls 39 prevent damage to wedge block 33, and are in turn, not damaged by screws 37 because of the hardness of the material used. Additionally, screws 37 can include cup points which rest over balls 39, distributing the pressure evenly. While steel is used in this preferred embodiment, it will be understood that other materials can be used. While a single screw 37 can be employed for each threaded insert 36, additional locking screws 41 can be employed. A locking screw 41 is threaded into threaded insert 36 on top of screw 37, locking it in position and preventing it from backing out and releasing the tension on wedge block 33.

With additional reference to FIGS. 6 and 7, it can be seen that backbone 32 has upwardly directed indexing surfaces 48 and 49 extending along opposing sides thereof. Second piece 40 overlies and partially encloses backbone 32 of first piece 20 and includes downwardly directed mating surfaces 52 and 53 engaging (abutting) indexing surfaces 48 and 49, respectively. Engaged mating surfaces 52 and 53 and indexing surfaces 48 and 49 align second piece 40 with first piece 20. In this embodiment, indexing surfaces 48 and 49 are upwardly directed and angularly opposed and mating surfaces 52 and 53 are downwardly directed and angularly opposed. Each of angularly opposed indexing surfaces 48 and 49 lies in a separate plane, which planes preferably intersect at a ninety degree angle. Thus, in this embodiment, two indexing surfaces 48 and 49 are provided which surfaces are angled at a preferred 45 degree angle with reference to a horizontal or vertical axis A. For purposes of this description, it will be understood that the term "angularly opposed" defines indexing surfaces that have intersecting planes, and that those intersecting planes of the indexing surfaces intersect at an angle greater than 0° and less than 180°, and preferably between 45° and 135°. This also applies to the mating surfaces which engage the indexing surfaces. While in this embodiment indexing surfaces 48 and 49 are two continuous surfaces extending from proximate front end 22 to proximate rear end 23, additional surfaces could be used, and they could be discontinuous (e.g. the continuous surfaces broken into a plurality of separate surfaces).

A receiving structure 55 is provided opposite mating surfaces 52 and 53 (on the outer surface) for receiving accessory devices such as sighting devices, and the like, mounted thereon. In this embodiment, receiving structure 55 is in the form of a Picatinny rail (MIL-1913) type system although other systems can be used. Also, as illustrated, receiving structure 55 extends the length of second piece 40 and handguard 45 which can be provided as a part of and extend from the end of second piece 40.

In order to provide the extreme accuracy of two piece upper receiver 14 of the present invention, indexing surfaces 48 and 49 and mating surfaces 52 and 53 are employed. To insure proper engagement (abutting relationship) between these surfaces, and thereby insure accurate and highly repeatable alignment, only mating surfaces 52 and 53 engage backbone 32 at indexing surfaces 48 and 49. Gaps 50 are defined between remaining portions of inner surface 42 and backbone 32 to insure this engagement with no distortions or interferences. Gaps 50 can be large or small and have substantially any shape, as long as only mating surfaces 52 and 53, and indexing surfaces 48 and 49 contact one another. Thus it will be understood that top 25 of first piece 20 and inner surface of second piece 40 can have a variety of shapes and configurations. By accurately and repeatably aligning first piece 20 and second piece 40 of two piece upper receiver 14, any accessory devices (e.g. optical sights, projection devices, etc.) carried by receiving structure 55 remain as originally aligned even after disassembly and reassembly.

Fasteners are employed to fixedly attach second piece 40 to first piece 20 to form complete upper receiver 14. Fasteners in this embodiment include screws 60 which pass through second piece 40 and threadably engage first piece 20. In this embodiment, apertures are formed in the top surface of backbone 32 and threaded inserts 62 are fit therein to provide tighter tolerances. Screws 60 are counter sunk in receiving structure 55 to prevent interference with accessory devices attached thereto, and threadably engage threaded inserts 62. Screws 60 are positioned down through the top of second piece 40 and first piece 20 to pull second piece 40 downwardly onto first piece 20, aligning in a repeatable manner first piece 20 with second piece 40 by the engagement between mating surfaces 52 and 53, and indexing surfaces 48 and 49.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. An upper receiver comprising:

a first piece;

a backbone, where the backbone is operatively attached to the first piece, where the backbone has a first indexing surface and a second indexing surface, where the backbone has an aperture;

a second piece, where the second piece has a first mating surface and a second mating surface;

a fastener;

a barrel nut having an outer surface, a barrel nut coupling a smooth breech end of a barrel to a front end of the first piece; and an insert, where the insert fits into the aperture, where the insert is configured to receive the fastener, where the second piece is configured to be secured to the first piece by insertion of the fastener through a portion of the second piece and into the insert, where the first indexing surface is configured to contact the first mating surface when the second piece is secured to the first piece, where the second indexing surface is configured to contact the second mating surface when the second piece is secured to the first piece.

2. The upper receiver according to claim 1, where the aperture is threaded, where the insert configured to fit into the aperture by screwing into the threads of the aperture.

3. The upper receiver according to claim 1, where the insert is made from a material different than the first piece.

4. The upper receiver according to claim 1, where the first piece and the second piece contact surfaces only where the first indexing surface contacts the first mating surface and where the second indexing surface contacts the second mating surface.

5. The upper receiver according to claim 1, where the first indexing surface is angularly opposed to the second indexing surface by an angle between about 45 degrees and about 135 degrees.

6. The upper receiver according to claim 1, where the second piece further includes:

a receiving structure, where the receiving structure is configured to receive attachments, where the receiving structure includes a counter sunk aperture configured to accept the fastener.

7. The upper receiver according to claim 6, where the receiving structure is a Picatinny rail.

8. The upper receiver according to claim 7, where the receiving structure is also part of a handguard.

9. The upper receiver according to claim 8, further comprising:

a wedge block, the wedge block lying between a portion of the second piece and the barrel nut; and a tensioning system, the tensioning system forcing the wedge block against the barrel nut.

10. The upper receiver according to claim 9, where the tensioning system includes:

a threaded insert received within an aperture extending through the second piece;

a screw threaded through the threaded insert and engaging an upper surface of the wedge block, where the tensioning system is configured to force the wedge block against the barrel nut when the screw is tightened.

* * * * *